US006176455B1

(12) United States Patent
Ma

(10) Patent No.: US 6,176,455 B1
(45) Date of Patent: Jan. 23, 2001

(54) BAG HOLDING DEVICE FOR REFUSE CONTAINERS

(76) Inventor: Agnes S Ma, 34596 Calcutta Dr., Fremont, CA (US) 94555-3106

( * ) Notice: Under 35 U.S.C. 154(b), the term of this patent shall be extended for 0 days.

(21) Appl. No.: 09/375,186

(22) Filed: Aug. 16, 1999

(51) Int. Cl.[7] ..... B65B 67/04; B65B 1/04; B65F 1/04; B67C 3/00

(52) U.S. Cl. ..... 248/101; 220/908.1; 141/391

(58) Field of Search ..... 248/95, 101, 97, 248/99, 100; 141/314, 391, 114, 313, 315; 383/33; 220/908, 908.1, 495.06, 495.08, 629, 529

(56) References Cited

U.S. PATENT DOCUMENTS

| | | | | |
|---|---|---|---|---|
| 1,230,734 | * | 6/1917 | Lilja | 248/99 |
| 3,788,720 | * | 1/1974 | Schneider | 248/99 |
| 3,977,450 | * | 8/1976 | Schampier | 248/95 |
| 4,069,993 | * | 1/1978 | Shanks | 248/101 |
| 4,558,800 | * | 12/1985 | Isgar et al. | 248/95 |
| 4,919,374 | * | 4/1990 | Julian | 248/95 |
| 4,921,196 | * | 5/1990 | Rudko | 248/99 |
| 4,946,065 | * | 8/1990 | Goulter et al. | 248/95 |
| 5,405,043 | * | 4/1995 | Meloney | 220/529 |
| 5,597,022 | * | 1/1997 | Reifers | 141/391 |
| 5,797,567 | * | 8/1998 | Magnafici | 248/101 |
| 5,915,584 | * | 6/1999 | Sposit et al. | 220/908.1 |

* cited by examiner

*Primary Examiner*—Ramon O. Ramirez
*Assistant Examiner*—Jon A Szumny
(74) *Attorney, Agent, or Firm*—Michael I Kroll

(57) ABSTRACT

A bag holding device for refuse containers 12will suspend a platform 36 using a plurality of elastic cords 20 to provide for greater accessibility to the bag 22. A plurality of U-shaped clips 14 are disclosed spaced apart about the upper lip 16 of a refuse container 12 being attached to the refuse bag 22 in such a manner as to maintain the bag 22 in an open position. Alligator-like clips 18 are used to secure the bag 22 to the U-shaped clips 14 and a ring 30 is used for attaching the elastic cords 20 and the alligator-like clips 18 to the U-shaped clips 14.

15 Claims, 7 Drawing Sheets

ALTERNATE EMBODIMENT

ALTERNATE EMBODIMENT

BAG HOLDING DEVICE FOR REFUSE CONTAINERS

BACKGROUND OF THE INVENTION

1. Field of the Invention

Figure 1:
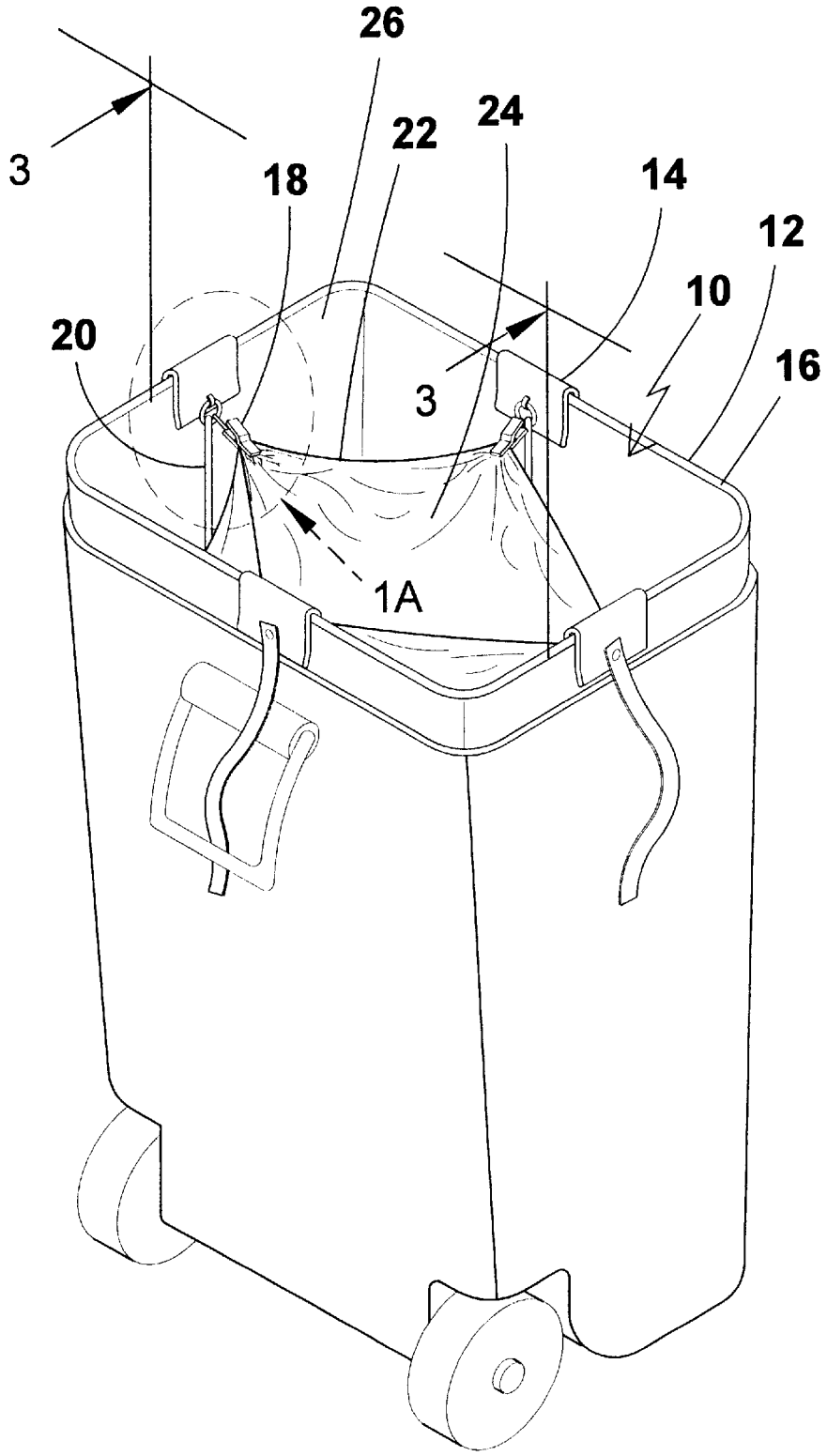

The present invention relates generally to bag holding devices for refuse containers and, more specifically, to a bag holding device for refuse containers which will provide a weight-responisive depth adjusting platform.

2. Description of the Prior Art

There are numerous bag holding devices for refuse containers known in the prior art. While these bag holding devices may be suitable for the purposes for which they were designed, they would not be as suitable for the purposes of the present invention as heretofore described. It is thus desirable to provide a bag holding device for refuse containers that will suspend a platform to prevent the bag from falling to the bottom of the container when weight is put into the bag. It is further desirable to provide a bag holding device for refuse containers wherein the suspended platform is supported by elasticized cords that will stretch as the bag fills.

SUMMARY OF THE PRESENT INVENTION

The present invention discloses a bag holding device for refuse containers and, more specifically, a bag holding device for refuse containers which will suspend a platform using a plurality of elastic cords to provide for greater accessibility to the bag. A plurality of U-shaped clips are disclosed spaced apart about the upper lip of a refuse container being attached to the refuse bag in such a manner as to maintain the bag in an open position. Alligator-like clips are used to secure the bag to the U-shaped clips and a ring is used as a means for attaching the elastic cords and the alligator-like clips to the U-shaped clips.

A primary object of the present invention is to provide a bag holding device for refuse containers which will overcome the shortcomings of prior art devices.

Another object of the present invention is to provide a bag holding device for refuse containers that will keep the top of the bag spread apart in an open position in order to readily receive items that are to go into the bag.

Another object of the present invention is to provide a bag holding device for a refuse container which uses alligator style bag clips for a quick and easy means for securing and releasing the bags. The bag clips are connected to an elasticized cord which is fastened to an attachment ring on the anchor clips fastened to the top of the container.

A still further object of the present invention is to provide a bag holding device for a refuse container that is temporary and versatile enough to adapt to different sizes and styles of existing garbage cans. The anchor clips slide over the lip of the container and use tension to remain secure allowing the user to slide them on and off without difficulty over containers of varying gauges.

A yet further object of the present invention is to provide a bag holding device for a refuse container with a suspended retaining platform to prevent the bag from falling to the bottom of the receptacle thereby saving the user from the inconvenient and unsanitary necessity of reaching into the can to pull up the bag.

Another object of the present invention is to provide a bag holding device for refuse containers with a suspended retaining platform that is supported by elasticized cords secured to the anchor clips fastened to the top of the can. The platform will then lower itself as the bag is filled due to the increase in weight.

Another object of the present invention is to provide a bag holding device for refuse containers with a suspended retaining platform that has a means for alerting the user that the bag holding device is in use and must be removed prior to trash pick-up.

A yet further object of the present invention is to provide a bag holding device for refuse containers with a suspended retaining platform that can be permanently affixed to an existing container with only minor modifications. A hole could be drilled in the bottom of the container to receive a securing bolt. An elasticized cord would run from the securing bolt at the base of the container to the retaining platform thereby securing the platform to the interior of the container and eliminating the need to remove the present invention prior to pick-up.

A still further object of the present invention is to provide a bag holding device for refuse containers with a suspended retaining platform wherein the weight of the retaining platform pulling down on the cords helps to maintain placement of the anchor clips on the container lip.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 1 is a perspective view of the present invention in use. Shown is a refuse container with the present invention inserted and held in place by four tension-grip anchor clips placed over the lip of the can. Each anchor clip is attached to an alligator-style bag clip by an elasticized cord. A bag is placed inside the refuse container and secured by the four bag clips which gently pull the bag opening towards the container wall. The bag is now ready to receive objects.

Figure 1A:
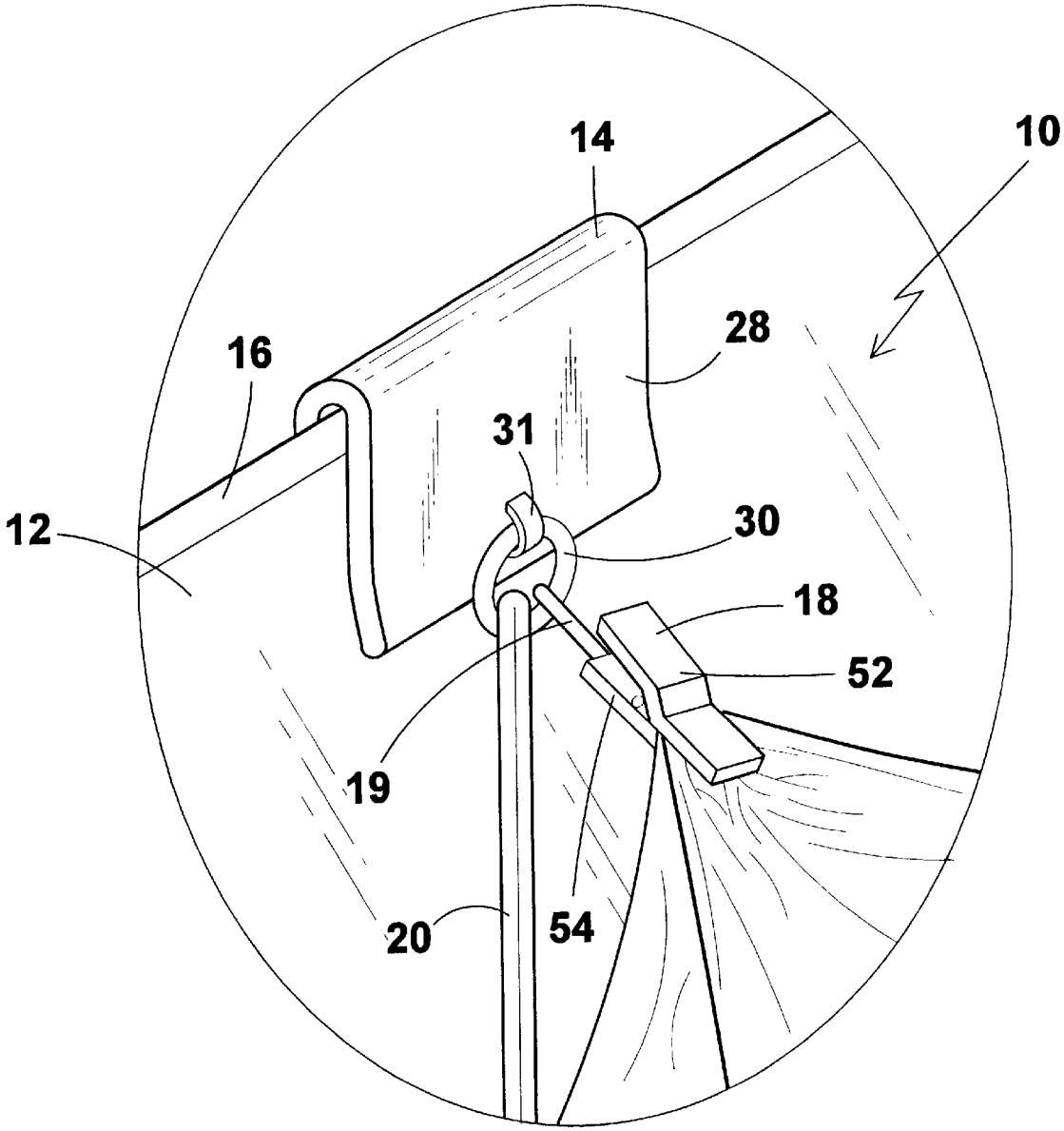

FIG. 1A is a detailed perspective view of the present invention, taken from FIG. 1 as indicated, slowing the u-shaped anchor clip slipped over the lip of the container. The interior portion of the anchor clip holds an attachment ring that the cords extending to the platform and the bag clips are connected to.

Figure 2:
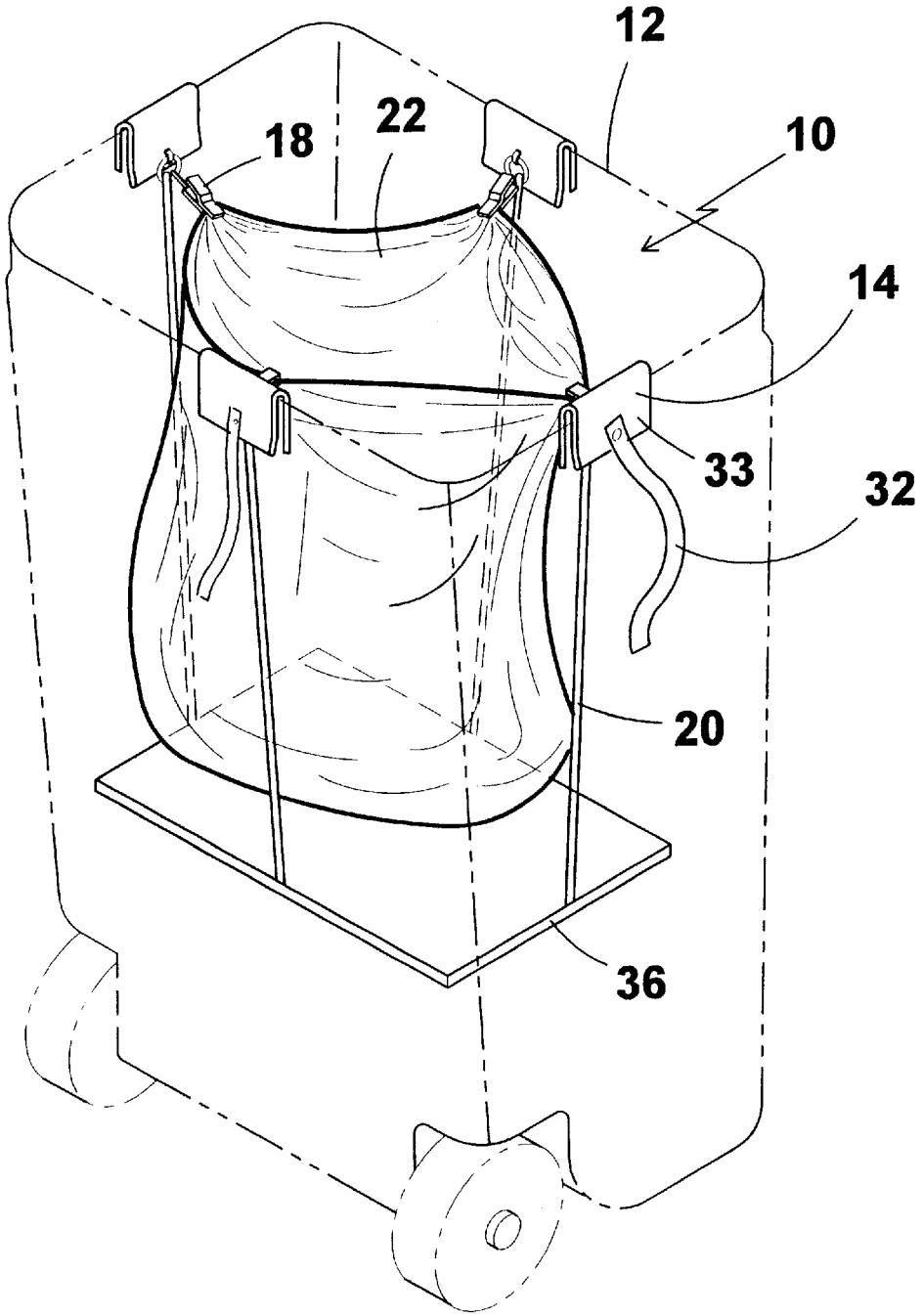

FIG. 2 is a perspective view of the present invention in use with a bag secured by the bag clips. The anchor clips have brightly colored flags on the portion that is on the containers exterior to indicate to the user that the present invention is in use and must be removed prior to emptying. A refuse container is shown in outline.

Figure 3:
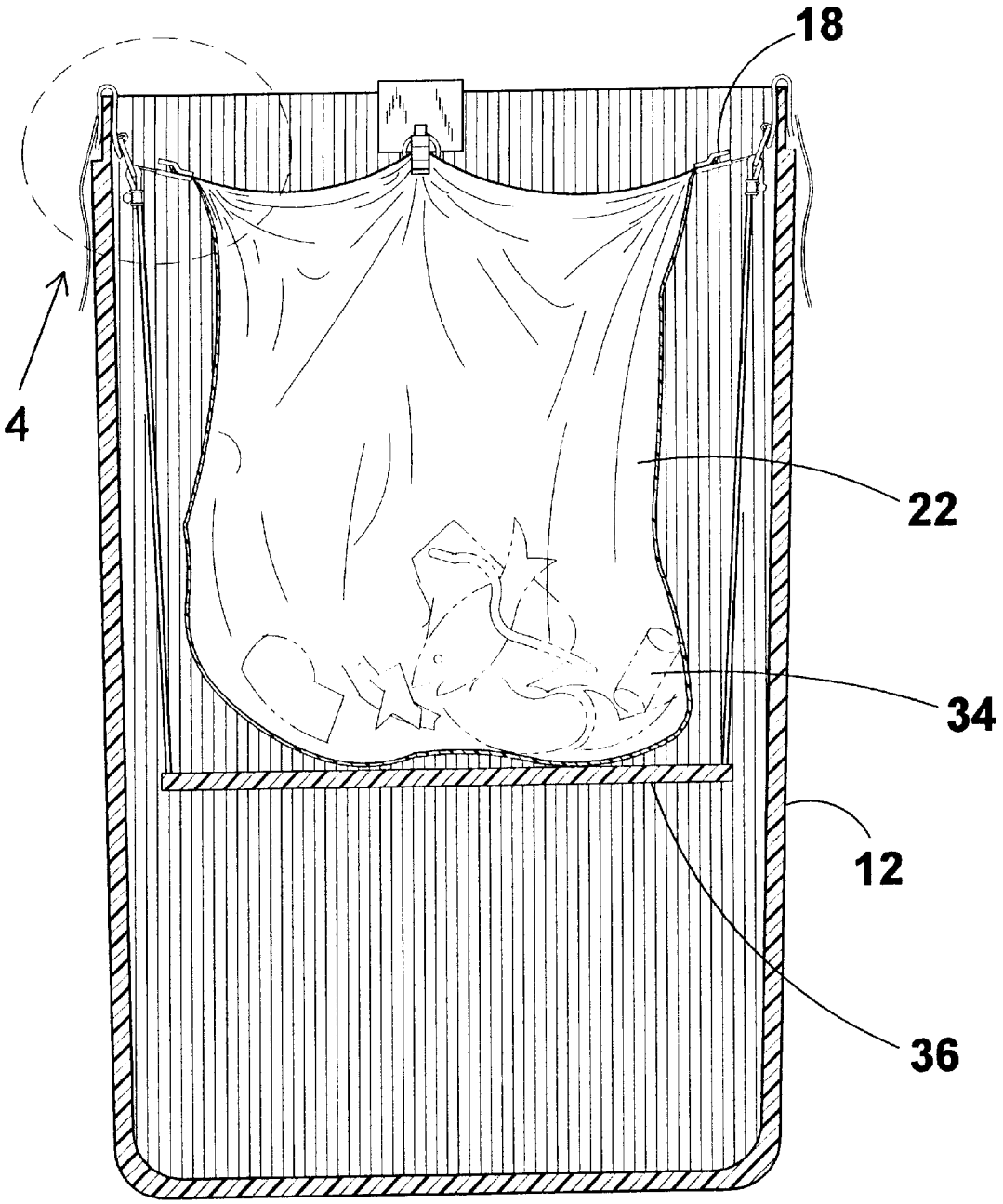

FIG. 3 is a cross-sectional view of the present invention in use, taken from FIG. 1 as indicated. The bag is placed in the container and secured by the bag clips in an open position for easy accessibility. There is a small amount of trash shown in outline inside the bag. The bag is not falling to the bottom because the platform is supporting it. This feature is particularly useful when using oversized containers.

Figure 4:
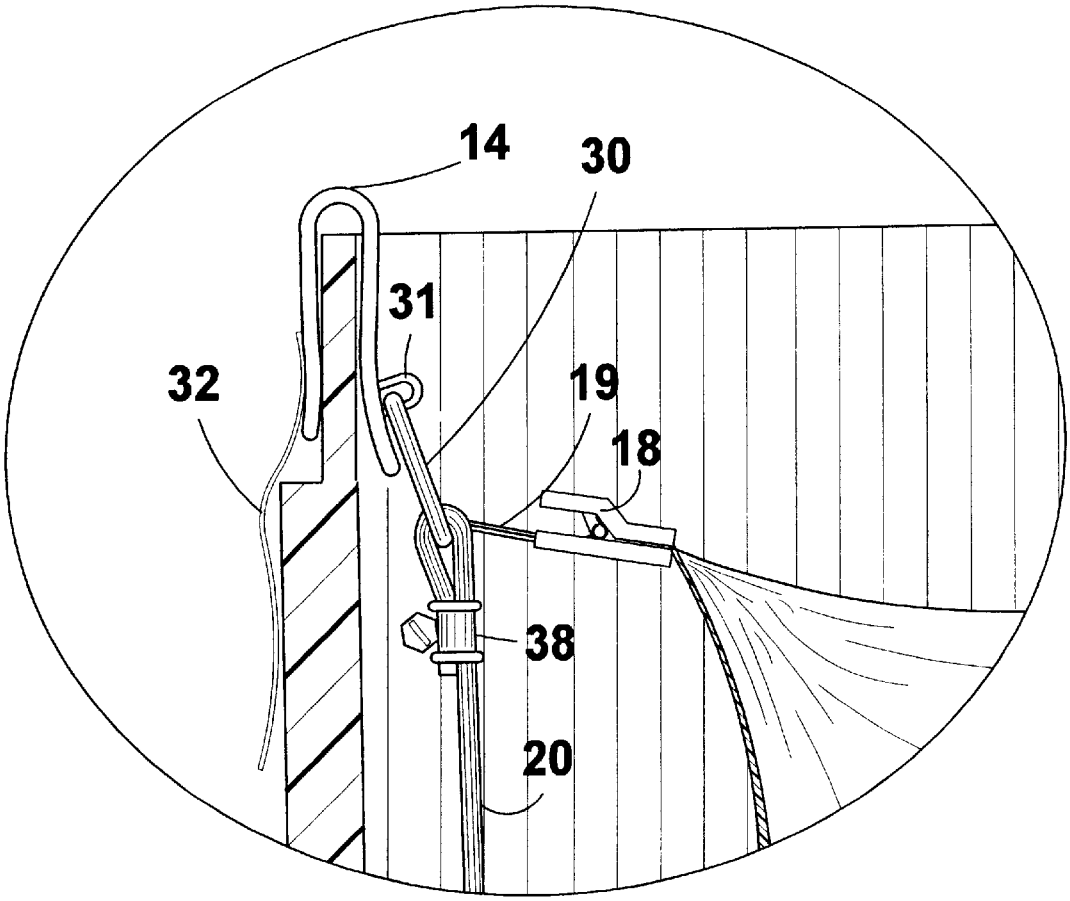

FIG. 4 is a detailed cross-sectional view showing the anchor clip in use taken from FIG. 3 as indicated. The attachment ring is supporting the cords for the bag clip and the platform. The platform cord has a clamp that provides for additional adjustability by the user.

Figure 5:
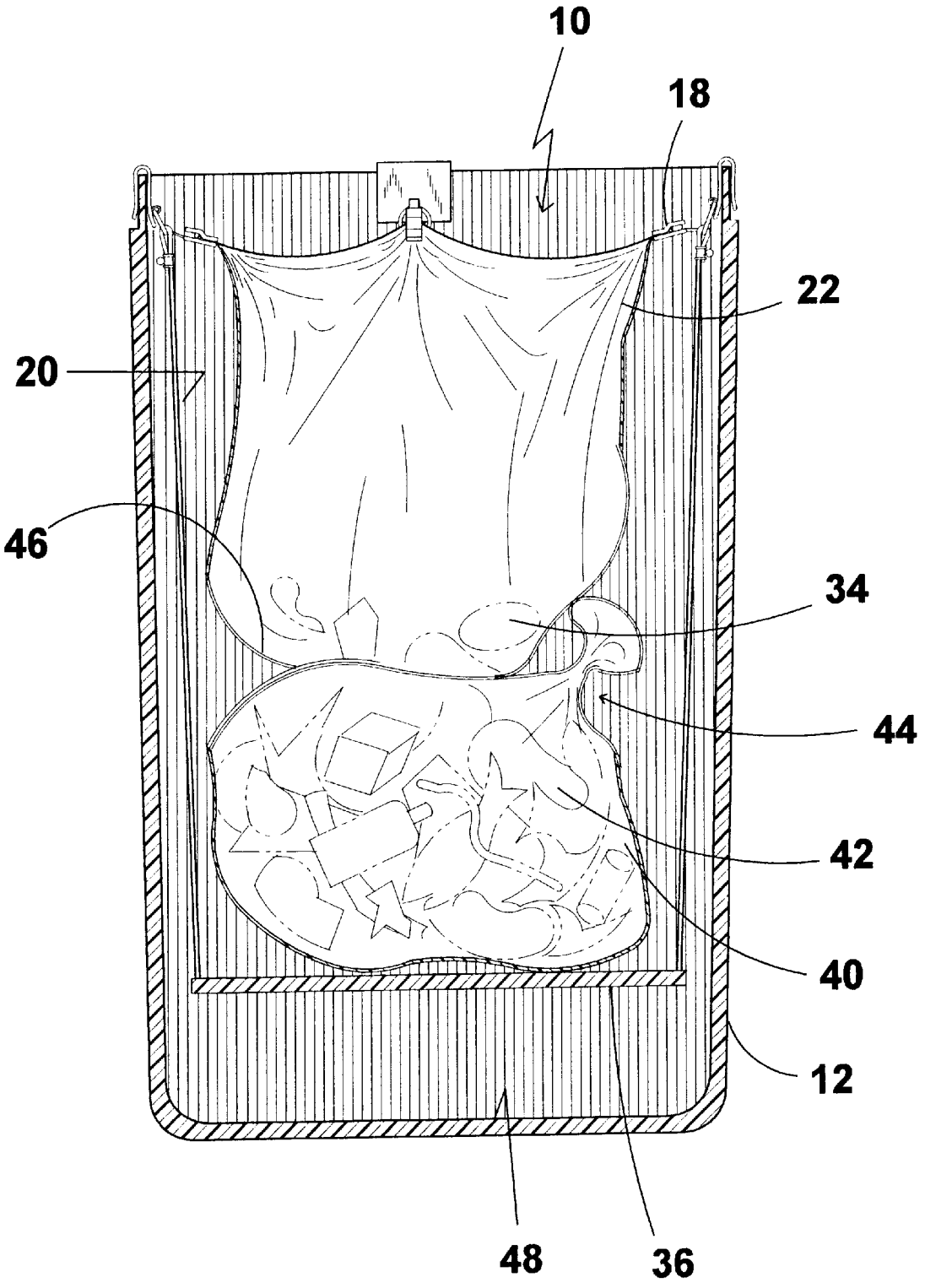

FIG. 5 is a cross sectional view of the present invention in use. One garbage bag has been filled and tied and another has been secured to the bag clips with the bottom sitting atop the first bag. The weight of the trash has stretched the platform support cords and dropped the platform towards the bottom of the container. When the second bag is filled and tied up, the present invention could be removed and the can emptied.

Figure 6:
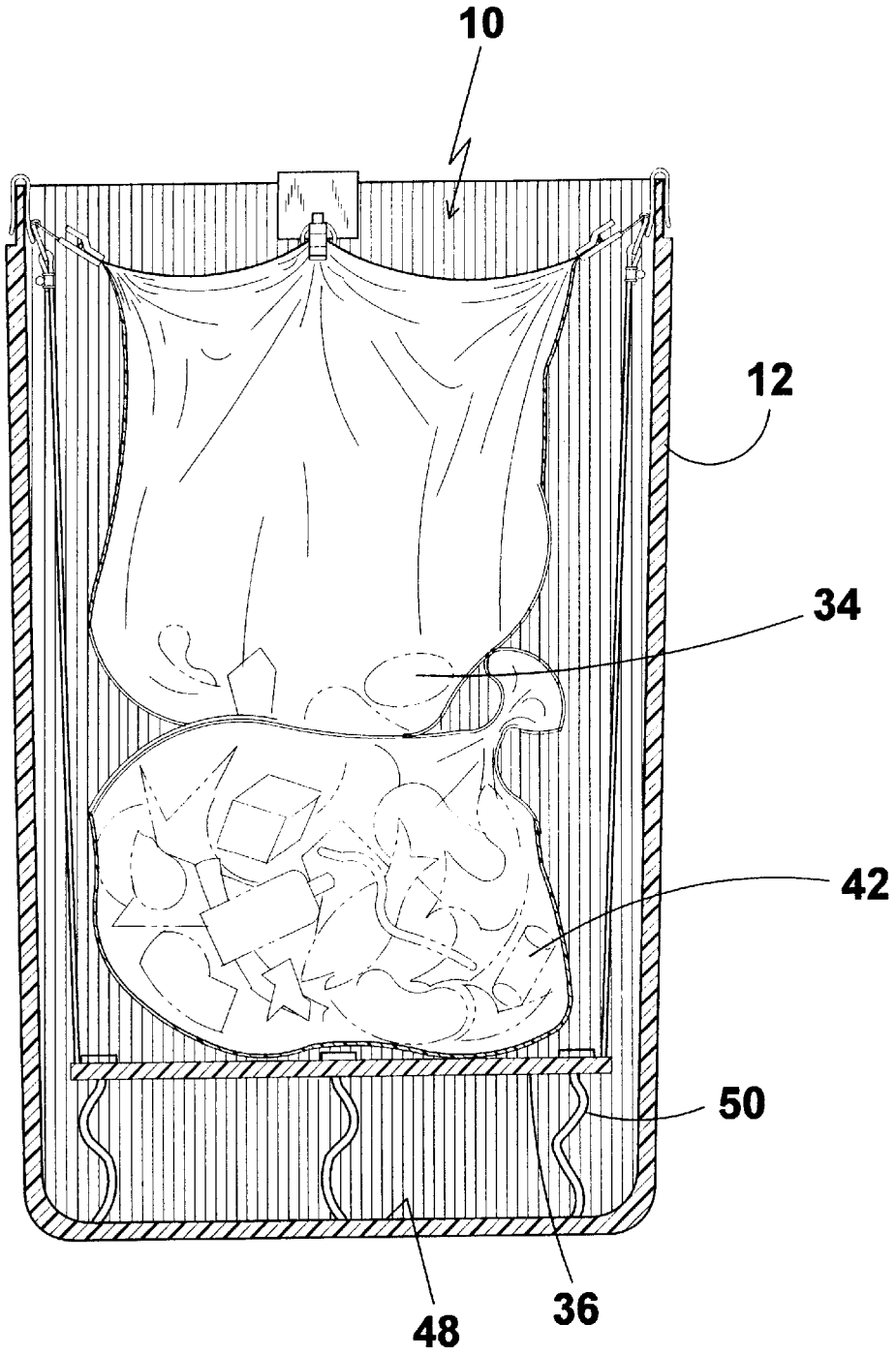

FIG. 6 is a cross sectional view showing an alternate embodiment of the present invention. Elasticized cords connect the platform to the bottom of the container to retain the platform inside the container when the trash is dumped. The anchor clips could then be fastened permanently to the can and the warning flags removed.

LIST OF REFERENCE NUMERALS

With regard to reference numerals used, the following numbering is used throughout the drawings:

10 present invention
12 refuse container
14 anchor clips
16 lip of refuse container
18 bag clip
19 elongated member
20 elastic cord
22 bag
24 opening of bag
26 wall of container
28 interior portion
30 attachment ring
31 means for attachment
32 flag
33 outer portion of bag clip
34 trash
36 platform
38 clamp
40 second garbage bag
42 trash
44 neck
46 bottom of bag
48 bottom of container
50 second elastic cord
52 clamp member
54 clamp member

BRIEF DESCRIPTION OF THE PREFERRED EMBODIMENT(S)

In order that the invention may be more fully understood, it will now be described, by way of example, with reference to the accompanying drawings in which FIGS. 1 through 6 illustrate the present invention being a weight responsive depth adjusting device for holding a refuse bag.

Turning to FIG. 1, shown therein is a perspective view of the present invention 10 in use. Shown is a refuse container 12 with the present invention 10 inserted therein and held in place by three or four tension-grip anchor clips 14 placed over the lip 16 of the container 12 in a spaced apart relationship about container 12. Each anchor clip 14 is attached to an alligator-style bag clip 18 by an attachment ring 20. A bag 22 is placed inside the refuse container 12 and secured by the four bag clips 18 which operates in a manner to gently pull the bag opening 24 towards the container wall 26. The bag 22 is now ready to receive objects.

Turning to FIG. 1A, shown therein is a detailed perspective view of the present invention 10, taken from FIG. 1 as indicated, showing the u-shaped anchor clip 14 slipped over the lip 16 of the container 12. The interior portion 28 of the anchor clip 14 holds the attachment ring 30 that elasaticed cords 20, extending to the platform, and the bag clips 18 are connected to. Ring 30 has means 31 for attachment to anchor clip on clamp 14. Bag clamps 18 have opposing members 52, 54 which are biased in a clamped position by spring means (not shown) and clips 18 have an elongated member 19 for connection to ring 30 and which passes through ring 30.

Turning to FIG. 2, shown therein is a perspective view of the present invention 10 in use with a bag 22 secured by the bag clips 18. The anchor clips 14 have brightly colored flags 32 on the outer portion 33 of clips 14 that is on the container 12 exterior to indicate to the user that the present invention 10 is in use and must be removed prior to emptying. A refuse container 12 is shown in outline. Platform 36 which supports the bottom of bag 22 is connected by cords 20 to clip 14.

Turning to FIG. 3, shown therein is a cross-sectional view of the present invention 10 in use, taken from FIG. 1 as indicated. The bag 22 is placed in the container 12 and secured by the bag clips 18 in an open position for easy accessibility. There is a small amount of trash 34 shown in outline inside the bag 22. The bag 22 is not falling to the bottom because the platform 36 is supporting it. This feature is particularly useful when using oversized containers 12.

Turning to FIG. 4, shown therein is a detailed cross-sectional view showing the anchor clip 14 in use taken from FIG. 3 as indicated. The attachment ring 30 is supporting the cords 20 for the bag clip 18 and the platform 36. The elastic cord 20 has a clamp 38 that provides for additional adjustability by the user. Attachment means 31 is also shown. Means 19 for attaching clip 18 to ring 30 is also shown.

Turning to FIG. 5, shown therein is a cross sectional view of the present invention 10 in use. A lower garbage bag 40 has been filled with trash 42 and tied at its neck 44 and another bag 22 has been secured to the bag clips 18 with the bottom 46 sitting atop the lower bag 40. The weight of the trash 34, 42 has stretched the platform support cords 20 and dropped the platform 36 towards the bottom 48 of the container 12. When the upper bag 22 is filled and tied up, the present invention 10 could be removed and the container 12 emptied.

Turning to FIG. 6, shown therein is a cross sectional view showing an alternate embodiment of the present invention 10. Elasticized cords 50 connect the platform to the bottom 48 of the container 12 to retain the platform 36 inside the container 12 when the trash 34, 42 is dumped. The anchor clips 14 could then be fastened permanently to the container 12 and the warning flags removed.

What is claimed to be new and desired to be protected by Letters Patent is set forth in the appended claims:

1. An apparatus to be placed inside a refuse container for holding trash, comprising:

a) a conventional flexible garbage bag adapted to be sized to fit on the inside of the refuse container;

b) a plurality of anchor clips for attachment in spaced apart relationship to the upper lip of the refuse container;

c) a generally horizontal planar platform upon which the bottom of said garbage bag can rest, said platform adapted to be sized fit inside the refuse container;

d) a plurality of downwardly extending elastic cords connected to said platform;

e) a first means for attaching said elastic cords to said anchor clips; and, f) a second means for attaching said bag to said anchor clips.

2. The apparatus of claim 1, said anchor clips further comprising a U-shaped member.

3. The apparatus of claim 1, wherein said anchor clips are three in number.

4. The apparatus of claim 1, wherein said anchor slips are four in number.

5. The apparatus of claim 1, further comprising a plurality of flags attached to said anchor clips.

6. The apparatus of claim 1, further comprising another plurality of downwardly extending elastic cords connected to the underside of said horizontal platform.

7. The apparatus of claim 6, wherein said another plurality of downwardly extending elastic cords are adapted to be connected to the bottom of said refuse container.

8. The apparatus of claim 1, wherein the number of downwardly extending elastic cords equals the number of anchor clips.

9. The apparatus of claim 2, wherein said U-shaped members are frictionally securable to said upper lip of said refuse container.

10. The apparatus of claim 1, said first means of attaching said elastic cord to said anchor clip further comprises a ring.

11. The apparatus of claim 1, said second means for attaching to said anchor clips further comprises a plurality of alligator-like clips.

12. The apparatus of claim 11, said alligator-like clips further comprising opposing members biased to a clamped position by spring means.

13. The apparatus of claim 12, said first means of attaching said elastic cords to said anchor clips further comprising a ring wherein said alligator-like clip is connected to said ring.

14. The apparatus of claim 13, wherein said alligator-like clip is connected to said ring by an elongated member.

15. The apparatus of claim 14, wherein said elongated member passes through said ring.

* * * * *